United States Patent [19]

Heyes et al.

[11] Patent Number: 5,055,647

[45] Date of Patent: Oct. 8, 1991

[54] ELECTRO-MAGNETIC INDUCTION HEATING OF STRIP MATERIAL

[75] Inventors: Peter J. Heyes, Wantage; Mark J. Rowland, Abingdon, both of United Kingdom

[73] Assignee: CMB Packaging (UK) Limited, United Kingdom

[21] Appl. No.: 472,027

[22] Filed: Jan. 30, 1990

[30] Foreign Application Priority Data

Jan. 31, 1989 [GB] United Kingdom ..... 8902090

[51] Int. Cl.[5] ..... H05B 6/08

[52] U.S. Cl. ..... 219/10.43; 219/10.61 R; 219/10.71; 219/10.77; 219/10.79

[58] Field of Search ..... 219/10.61 R, 10.71, 219/10.69, 10.75, 10.77, 10.79, 10.41, 10.43, 10.57

[56] References Cited

U.S. PATENT DOCUMENTS

| | | | |
|---|---|---|---|
| 3,444,346 | 5/1969 | Russell et al. | 219/10.61 R |
| 3,946,349 | 3/1976 | Haldeman III | 219/10.79 |
| 4,258,241 | 3/1981 | Soworowski | 219/10.71 |
| 4,357,512 | 11/1982 | Nishimoto et al. | 219/10.61 R |
| 4,678,883 | 7/1987 | Saitoh et al. | 219/10.61 R |
| 4,708,325 | 11/1987 | Georges | 219/10.61 R |
| 4,770,355 | 9/1988 | Mori et al. | 219/10.79 |
| 4,788,394 | 11/1988 | Vanneste et al. | 219/10.61 R |
| 4,828,227 | 5/1989 | Georges et al. | 219/10.61 R |

*Primary Examiner*—Philip H. Leung

*Attorney, Agent, or Firm*—Wood, Phillips, Mason, Recktenwald & VanSanten

[57] ABSTRACT

An electro-magnetic induction heater has a heating coil which defines a throat through which a metal strip (moving towards a plastics film laminating station) passes thereby to be heated to a laminating temperature. The coil turns are flexible, and are braced at spaced positions in braces which are mounted for movement towards and away from the metal strip. Each brace has an associated adjustment means. The positions of the respective braces are adjusted during heating, preferably automatically, so as to adapt the coil throat shape to the varying cross section (and/or other characteristics) of the strip to be heated, thereby to ensure uniform temperature distribution across the width of the strip. Under automatic control each adjustment means is operated in closed loop manner by associated actuating means in response to deviation from a reference level of a sensed temperature signal provided by an associated sensor positioned adjacent the emergent heated strip.

19 Claims, 5 Drawing Sheets

ELECTRO-MAGNETIC INDUCTION HEATING OF STRIP MATERIAL

This invention relates to a method of and an apparatus for the electro-magnetic induction heating of a metal workpiece. Such a workpiece may comprise, for example, a metal sheet or strip material (referred to collectively hereafter for convenience as 'metal strip'), particularly thin metal strip of rectangular transverse cross section, and more particularly such thin metal strip of such materials and thicknesses as are used in the manufacture of metal cans for receiving and storing foods and beverages.

The internal surfaces of such metal cans are treated so as to provide on them a protective coating for preventing the contents of a filled can from coming into contact with and corrosively reacting with the metal walls of the can.

Such a coating may comprise a lacquer, which is deposited on to the respective internal surfaces after the can parts have been shaped from flat metal strip, or on to thin metal strip that is to be used for making such can parts.

Alternatively, the coating may comprise a film of a synthetic plastics material which is laminated with and bonded to metal strip that is to be used for forming the can parts.

Such a film of plastics material has then to withstand the pressures and forces that have to be applied to the metal strip/film laminate in order to form the can parts therefrom. Hence, not only must the film material itself be able to withstand those deforming pressures and forces, but it must also remain firmly bonded at all parts thereof to the metal strip during the can forming processes.

Bonding may be effected by the use of an adhesive layer between the metal strip and the plastics film, or by bonding the film material itself to the metal strip.

In the latter case, the metal must be heated uniformly to a predetermined temperature (typically in the range 120° C. to 300° C.) at which the film may be applied to the heated metal strip. Bonding of the film material then takes place satisfactorily when the laminate (i.e. the metal strip and adherent film material) is reheated to a temperature typically between 200° C. and 290° C. depending on the particular polymer film being used.

Various methods of achieving the necessary heating of the metal strip/film laminate are available, but the most advantageous method employs high frequency electro-magnetic induction heating of the metal strip itself. In this method, the metal strip is heated directly, and selectively at its surfaces by circulating electric currents that are induced therein by an oscillating magnetic field, without the use of any intermediate agency for transferring heat to the metal surface.

The temperature at which bonding of a film material takes place is somewhat critical, so that the metal surface must be evenly heated to the requisite temperatures (a) for example 120° C., in readiness for uniting the metal strip and film material at the time of pressing them into contact in the nip of a pair of pressure rolls, and subsequently (b) for example 250° C., to complete the bonding process of the united strip and film.

However, metal strip suitable for can production is not entirely homogenous in its composition (and thus, its physical characteristics), and moreover, the dimensions and shape of its transverse cross section can change within prescribed manufacturing limits (for example, at the centre of the strip +/− 8.5% of the nominal thickness, and at the sides of the strip 0 to −8% of the thickness at the centre).

Moreover, the nature of the gauge variations in a strip can vary from strip to strip, and the strip can be wavy along its length (i.e. the strip is not truly flat).

Thus, to achieve satisfactory bonding of a plastics film material to a metal strip, it is necessary that the metal strip be heated in such a way and at such a rate that the temperature of the heated metal (moving at a speed typically in the range 4 to 400 metres per minute) is substantially uniform, both across the width and along the length of the strip.

Some known electro-magnetic induction heating systems involve passing a ferrous metal strip longitudinally through the throat of a multi-turn induction heating coil, of which the respective turns are of rigid construction, are rigidly supported in position, and have a predetermined fixed transverse cross-sectional shape suited to a particular strip to be heated. Moreover, such coils are cooled by passing cooling water through a cooling pipe which is secured in good thermal relation to the external surface of the conductor constituting those turns of the coil, so that the cooling of the conductor occurs indirectly by virtue of the transmission of heat through the wall of the cooling pipe.

However, such heating systems have been unable to achieve the desired uniform temperature distribution in the metal strip leaving the throat of the heating coil, with the result that uneven bonding of the laminated film and metal strip has occurred, or uneven physical characteristics in the polymer film have developed. This deficiency of the prior art systems arises principally from the variations that occur, both longitudinally and transversely of the strip, in the thickness of the metal strip, in the flatness of it, and in its magnetic permeability.

Our experience with certain prior art systems has shown that such systems tend to induce in the edge or side parts of the heated strip temperatures which are different from, typically some few (e.g. six) per cent higher than, those at the central parts of the strip.

Furthermore, the heating coils of such prior art systems have each been designed for specific sizes of metal strip, and cannot be readily adapted for use with any other size of metal strip. Thus, a collection of different heating coils has had to be stored for use when required with appropriate sizes of metal strip, and unavoidable down-time has occurred whenever a heating coil has had to be changed.

We have become aware of the following prior art patent specifications which relate to this art: British specification Nos. 1,021,960 (Deutsche Edelstahlwerke AG) and 1,522,955 (Rolls-Royce Ltd); European specification No. A2-0,246,660 (Kabushiki Kaisha Meidensha); German specification DAS No. 1,301,405 (Brown Boveri & Cie AG); U.S. Pat. Nos. 1,861,869 (Long) and 3,424,886 (Ross).

All of these prior art specifications disclose some means of adjusting the cross sectional shape of the throat of an induction heating coil; and with the exception of the British specification No. 1,522,955, adjustment of the coil throat shape has been made in preparation for and before commencement of the induction heating of a workpiece, that is, the coil throat shape has been pre-adjusted before heating the workpiece.

Whilst in some of those specifications, such pre-adjustments have been made for the purpose of adapting the coil throat to the shape and size of the transverse cross section of the workpiece, in other specifications pre-adjustment has allegedly been made for the purpose of ensuring substantial uniformity of temperature across the width of the heated workpiece, that is in a direction transverse to that of the movement of the workpiece.

In contrast thereto, British specification No. 1,522,955 disclosed an induction heating system which operates in conjunction with a workpiece hot-drawing apparatus, with the objective of moving the induction heating coil progressively along the workpiece as the workpiece is progressively drawn by respective jaws thereby to increase its length. The process is applied to workpieces (e.g. solid or hollow blades for a gas turbine) of varying, non-uniform transverse cross section. The induction coil has coil turns formed from a thin, flexible, flat strip material. That strip material is enclosed in an elastomeric sleeve through which cooling water flows directly in contact with the strip material. The coil turns are carried at circumferentially spaced positions by respective supports which are adjusted in position relative to the workpiece during the simultaneous heating and drawing processes by cam followers which cooperate with respective cams. The cams and cam followers are coupled to the respective jaws so as to change the shape of the coil turns as the jaws move apart. The objective of the system is to maintain a substantially constant distance between the induction coil and the surface of the workpiece, typically at "about three-sixteenths of an inch". In this system, the adjustment of the shape of the heating coil turns is carried out in a preset manner, and without reference to the actual temperature of the workpiece, or any part thereof.

We have found that, in the context of induction heating thin, elongate strip metal in preparation for and during the process of uniting and bonding the strip metal with a plastics film material, it is insufficient to merely pre-adjust the shape of the heating coil throat so as to adapt it to the nominal transverse cross section of the metal strip, due to the lack of total homogeneity of the strip metal.

The present invention seeks to overcome the above-recited deficiencies of the prior art systems, and to provide an induction heating system which is both (a) readily adaptable so as to accommodate a wide range of metal strip sizes and materials, and (b) capable of producing in the outgoing metal strip a more uniform temperature distribution throughout both its transverse and longitudinal dimensions despite variations in the gauge, flatness, shape and position of the strip.

According to one aspect of the present invention, there is provided a method of electro-magnetic induction heating an elongate metal strip, which method comprises the steps:

(a) providing (i) an induction heating coil having a throat through which a magnetic axis of the coil extends, the shape of the throat in a plane transverse to said axis being variable in directions normal to the magnetic axis of the coil, and (ii) a coil adjustment means coupled with said coil for varying said throat shape;

(b) adjusting the throat shape to suit the transverse cross section of the metal strip;

(c) energising the coil with an electro-magnetic induction heating current thereby to produce a varying magnetic field;

(d) moving the metal strip progressively through said magnetic field thereby to inductively heat the metal strip, said strip emerging at a downstream side of the magnetic field in a heated condition; and which method is characterized by the steps:

(e) monitoring the temperature of the heated metal strip at said downstream side thereby to provide a measurement of the temperature of the heated strip;

(f) comparing the temperature measurement with a preset temperature reference value to determine therefrom the deviation of the temperature measurement from said reference value; and (g) activating the coil adjustment means in a corrective sense in dependence upon said deviation, thereby to reduce said deviation.

In one preferred arrangement, the induction heating coil is arranged for movement of the metal strip through the coil throat in the direction of said magnetic axis, and the strip temperature is monitored at a position where the heated metal strip emerges from the coil throat.

Preferably, there is provided a plurality of local adjustment means for respectively varying the shapes of respective predetermined local parts of the coil thereby to vary the coil throat shape, in which case the method includes the steps of:

(h) monitoring the temperature of the heated metal strip at a plurality of predetermined local positions spaced apart across the width of the metal strip at the downstream side of the magnetic field thereby to provide respective measurements of the local strip temperatures at said respective local positions;

(i) for each such temperature measurement, comparing such measurement with a respective preset local reference value thereby to determine for the associated local position on the heated strip the deviation of the local temperature measurement from the associated reference value; and (j) in response to each such deviation, activating an associated one of the local coil adjustment means in a corrective sense thereby to vary the coil throat shape in dependence upon the deviation and so reduce the local temperature deviation.

Preferably, the induction heating coil is arranged for movement of the metal strip through the coil throat in the direction of said magnetic axis, and each such local strip temperature is monitored at a position where the heated metal strip emerges from the coil throat.

The induction heating coil preferably comprises a plurality of similar coil turns defining the coil throat, in which case each local adjustment means is adapted to adjust corresponding local parts of the respective coil turns simultaneously.

According to a second aspect of the present invention, there is provided an electro-magnetic induction heating apparatus for induction heating an elongate metal strip, which apparatus comprises:

(a) an electro-magnetic induction heating coil defining a throat through which a magnetic axis of the coil extends, the coil including flexible parts which permit the shape of the throat to be varied in directions normal to the magnetic axis, and the coil producing when energised a varying magnetic field in the coil throat;

(b) coil adjustment means coupled to the coil and adapted on activation thereof to adjust the coil thereby to vary the throat shape in said directions; and which apparatus is characterised by:

(c) temperature monitoring means disposed downstream of the coil throat and arranged to provide a measurement of the temperature of the heated metal strip;

(d) comparison means responsive to the temperature measurement and operative to determine the deviation of the temperature measurement from a preset reference value; and (e) activating means responsive to said deviation and adapted to cause the coil adjustment means to adjust the coil and thereby vary the throat shape in a sense tending to reduce the deviation.

Preferably, the induction heating coil is arranged for movement of the metal strip through the coil throat in the direction of the magnetic axis, in which case the temperature monitoring means is disposed at a position adjacent the downstream side of the coil throat.

In one preferred apparatus according to the present invention:

(a) the coil adjustment means comprises a plurality of local adjustment devices arranged respectively to adjust respective circumferentially-spaced local parts of the heating coil thereby to vary the coil throat shape;

(b) the temperature monitoring means comprises a plurality of temperature sensing devices disposed respectively at a plurality of predetermined local positions spaced apart across the width of the metal strip at the downstream side of the coil throat, thereby to provide respective measurements of the local strip temperatures at the respective local positions;

(c) the comparison means comprises a plurality of local comparison devices, each such device being responsive to a respective one of said local temperature measurements and operative to determine the deviation of the associated local temperature measurement from a respective preset reference value, and (d) the activating means comprises a plurality of local activating devices, each such device being (i) associated with a respective local comparison device and a respective local coil adjustment device, (ii) responsive to the associated local deviation, and (iii) operative in response to the local deviation to cause the associated local coil adjustment device to adjust the associated local part of the coil in a corrective sense thereby to vary the throat shape and so reduce the associated local deviation.

In one preferred form of said apparatus, the induction heating coil is arranged for movement of the metal strip through the coil throat in the direction of said magnetic axis, and the local temperature monitoring devices are disposed at their respective local positions adjacent the downstream end of the coil throat.

The induction heating coil preferably comprises a plurality of coil turns of a flexible electrical conductor, which turns define centrally the coil throat, and a plurality of local braces spaced circumferentially around the coil turns, each such brace locally securing the coil turns together for local adjustment together, and each such brace being coupled to a respective local adjustment device for adjustment thereby.

In one preferred apparatus, each local adjustment means includes a power operated actuating means for effecting operation of the local adjustment means in response to control signals supplied thereto in dependence upon the associated local deviation.

Each local activating means preferably includes an adjustable temperature reference device for providing a local temperature reference signal, and the activating means operates in response to the local temperature measurement and the local reference temperature signal in a closed loop manner so as to maintain the local temperature measurement in accordance with the local temperature reference signal.

A local temperature measuring device for measuring the temperature at a central position on the heated metal strip emerging from the coil throat may constitute the respective local temperature reference devices for the respective local activating means which cause adjustment of the local braces at positions other than the central position.

Preferably, the coil turns are wound from a flexible multi-strand conductor, or from a plurality of multi-strand conductors arranged mechanically and electrically in parallel with one another, so as to withstand frequent adjustment of the coil throat shape.

Preferably, each such flexible conductor comprises a multi-strand conductor of round cross sectional shape, and is drawn into a flexible pipe of a suitable electrically-insulating, plastics material and of a size such as to allow the flow of a cooling fluid through the pipe in direct contact with the multi-strand conductor thereby to cool that conductor when energised.

Other features of the present invention will appear from a reading of the description that follows hereafter, and of the claims appended at the end of that description.

One induction heating system incorporating the present invention will now be described by way of example and with reference to the accompanying diagrammatic drawings.

In the various Figures, parts that are the same as or analogous to parts shown in earlier Figures bear references the same as those used for the corresponding earlier disclosed parts.

Figure 1:
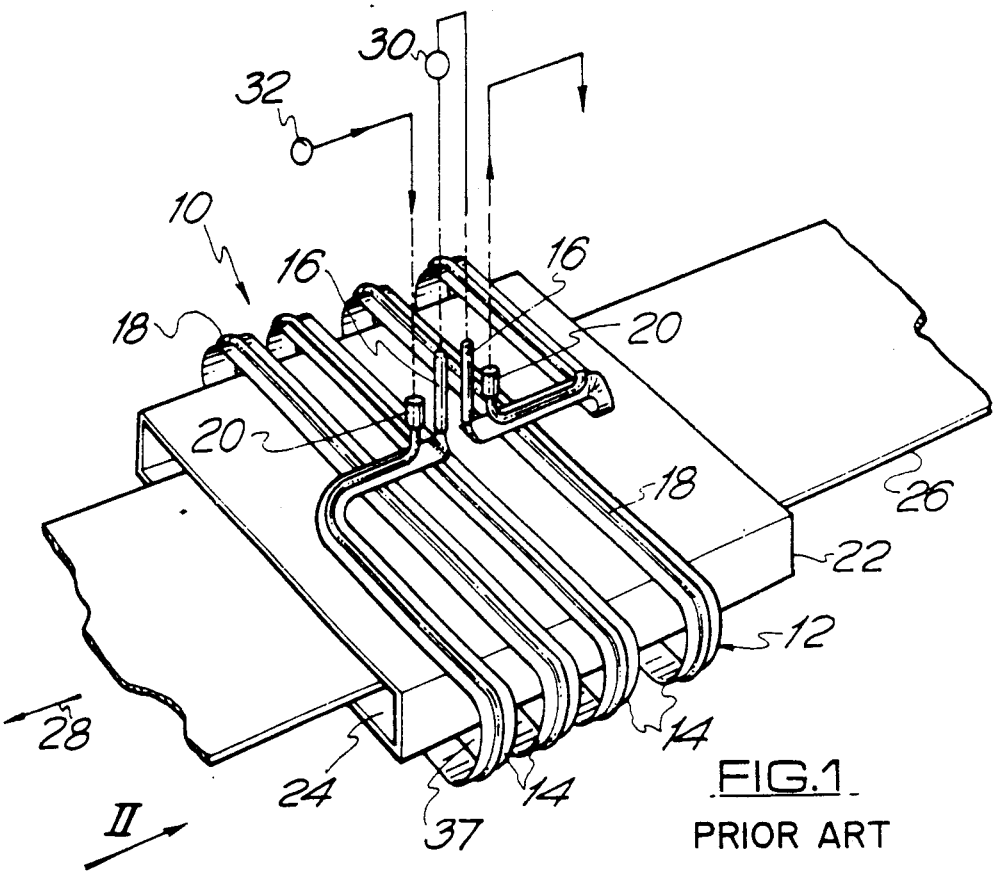
FIG.1 PRIOR ART
FIG. 1 is a perspective view of a known high frequency induction heater for heating a steel strip.
Figure 2:
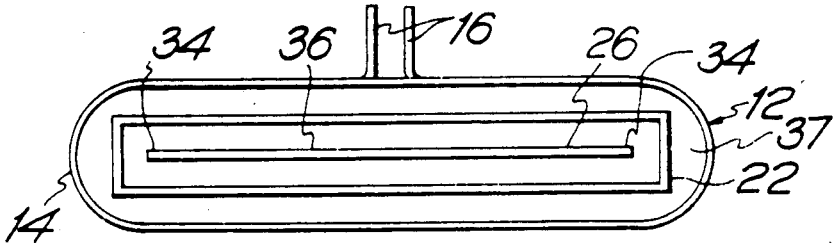
FIG.2 PRIOR ART
FIG. 2 is an end view looking in the direction of the arrow II shown in FIG. 1.

Referring now to the drawings, the induction heater 10 shown in the FIGS. 1 and 2 comprises a high frequency heating coil 12 constituted by a series of four spaced turns 14 of a rigid, solid electrical conductor, and having electrical terminals 16 located centrally and symmetrically of the coil. Secured to that conductor on the outside of the coil turns is a water cooling pipe 18 which is intimately secured to the conductor and has pipe connectors 20. Though shown separately, each such pipe connector 20 is usually integrated with the associated electrical terminal 16 for connection with a combined electric power and cooling water supply line. The turns of the coil are supported by support means (not shown) so as to be retained in their fixed configuration.

A tube 22 of an electrically-insulating material (e.g. self-extinguishing fibre glass material) and a rectangular transverse cross section is supported by support means (not shown) in the throat of the coil 12 in axial alignment with the magnetic axis of the coil. That tube defines a tunnel 24 through which metal strip 26 to be heated is passed in a central position in the direction of arrow 28. That tube thus constitutes a mechanical and an electrical barrier for preventing contact of the metal strip 26 with the coil turns 14, as well as a thermal barrier.

In known manner: the terminals 16 of the coil are supplied with an appropriate high frequency electrical current (typically in the frequency range 50 Hertz to 500 kiloHertz) from a supply generator 30 thereby to induce eddy currents in the metal strip, and so heat it, as the strip is progressively advanced through the tunnel; and the water cooling pipe 18 is connected with a suitable source 32 of cooling water thereby to effect cooling of the coil turns 14 to a desired low operating temperature.

FIG. 2 shows in end view the dispositions and configurations of the metal strip 26, the tunnel tube 22 surrounding it, and the coil turns 14 encircling the tunnel tube. In that view, the metal strip 26 is shown as being of a nominally rectangular transverse cross section, and the coil turns are shown as being at all positions equidistant from the surface of the metal strip.

It has been found in our private experiments that the side portions 34 of the strip achieve a temperature that is typically 6% higher than that achieved by the central parts 36 of the strip, for a given coil throat shape and strip size. This has been attributed primarily to edge effects in the metal strip, though the fact—that the transverse cross section of the metal strip is not truly rectangular, but is instead slightly 'barrel-shaped', with the strip tapering slightly towards the respective sides (edges) of the strip—may also have contributed to this uneven temperature distribution.

Figure 3:
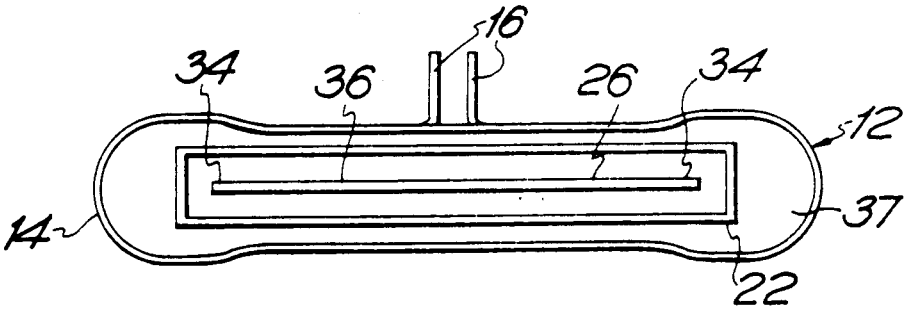
FIG.3 PRIOR ART
FIG. 3 is an end view similar to that of FIG. 2, showing a modified configuration of an induction heating coil incorporated in the induction heater of FIG. 1.

To compensate for this edge effect and the characteristic thinning of the side portions of the metal strip, the transverse cross sectional shape of the coil turns 14 (that is, of the coil throat 37) was modified in the manner shown in the FIG. 3, so as to increase the distance of the side portions of the metal strip from the curved side portions of the coil turns 14, and so decrease the magnetic flux density in, and hence the heating of, those side portions of the metal strip.

Whilst this modification has provided some beneficial reduction of the disparity between the temperatures at the central and side portions respectively (and has in some cases even reversed it), the results are not wholly satisfactory, nor predictable with any high accuracy, and condiderable variation of surface temperature across the width of the metal strip can still occur. Moreover, by increasing the cross sectional area of the coil throat 37, and hence the volume occupied by the magnetic flux, the efficiency of the coil has been diminished. There is thus a compromise to be made between seeking a desired uniform temperature distribution across the width of the metal strip (despite waviness in the strip and deviation of the strip from a central position in the coil throat), and seeking a high electrical efficiency in heating the strip.

We have discovered in our experiments that by rendering the coil turns flexible and supporting them at positions spaced circumferentially around the coil in longitudinal braces whose positions are adjustable in respective directions towards and away from the metal strip, a more uniform temperature distribution across the width of the metal strip can be obtained by simply adjusting appropriate ones of the braces to vary the shape of the coil throat 37 in a corrective manner. Such a facility, enabling the in-situ modification of the coil throat shape, permits the user to seek on the factory floor the best compromise between uniformity of surface temperature and heating coil efficiency.

Moreover, such an arrangement permits the ready in-situ adaptation of the coil throat shape to suit the physical dimensions and magnetic and other characteristics of any particular metal strip that is to be heated.

To improve the ability of the coil to change its throat shape by adjustment of such movable braces, we have substituted for the rigid, solid conductor material used for the coil turns 14 of the embodiments of FIGS. 1-3, flexible, multi-strand copper conductors (as used, for example, as electrode holder cables in electric arc welding systems). The high flexibility of such multi-strand conductors is particularly advantageous where frequent adjustment of the coil throat shape might otherwise induce fatigue failure of the coil turns.

The use of such a flexible conductor material renders it practicable to provide for each adjustable brace (or for each of a plurality of groups thereof) a closed loop control means for continuously (or continually) positioning it (or them) in dependence upon the deviation from a set reference level of a monitored local strip surface temperature. With such an arrangement the high flexibility of such multi-strand conductors is particularly advantageous in that it minimises the risk of fatigue failure of the coil conductors due to the frequent adjustment of the coil throat shape.

Such closed loop control means may respond to the output of a single temperature sensor positioned at a predetermined optimum position (e.g. a central position) relative to the width of the strip being heated, and maintain the sensed temperature in accordance with a set temperature reference signal.

Alternatively, each such adjustable brace (or group of them) may be provided with its own individual temperature sensor located at a position corresponding to the position of the brace (or group of braces), and be controlled by its own associated closed loop means in response to the output of the associated temperature sensor. In such a case, the various closed loop control means may be arranged to maintain the respective sensed temperatures in accordance with a reference temperature constituted by the temperature sensed at the central position on the metal strip.

Preferably, each such adjustable brace is carried by a pair of parallel links arranged so that the brace is constrained to move in a manner parallel to the metal strip being heated.

We have also found that such flexible multi-strand conductors can be readily drawn into suitable flexible hose pipes of an electrically-insulating plastics material and of a bore size sufficient to allow an adequate flow of a cooling water therethrough in direct contact with the flexible conductor. Thus, the heating coil can be cooled by cooling water flowing directly in contact therewith.

In one preferred embodiment of the present invention shown diagrammatically in the FIGS. 4–8, the induction heater 10 is generally similar to that described earlier with reference to the FIGS. 1 and 2, in that it comprises a multi-turn coil 12 encircling an insulating tunnel tube 22 through which metal strip 26 is passed for eddy current heating.

However, in this coil 12 each of the five coil turns 14 comprises five similar, flexible copper conductors 38 (best seen in the FIG. 7) which are connected electrically and mechanically in parallel at terminals 16. Those terminals are disposed close together (to reduce magnetic field leakage) and are connected to a high frequency A.C. supply source 30 via conductors 40, and to a cooling water supply source 32 via pipes 42.

Figure 8:
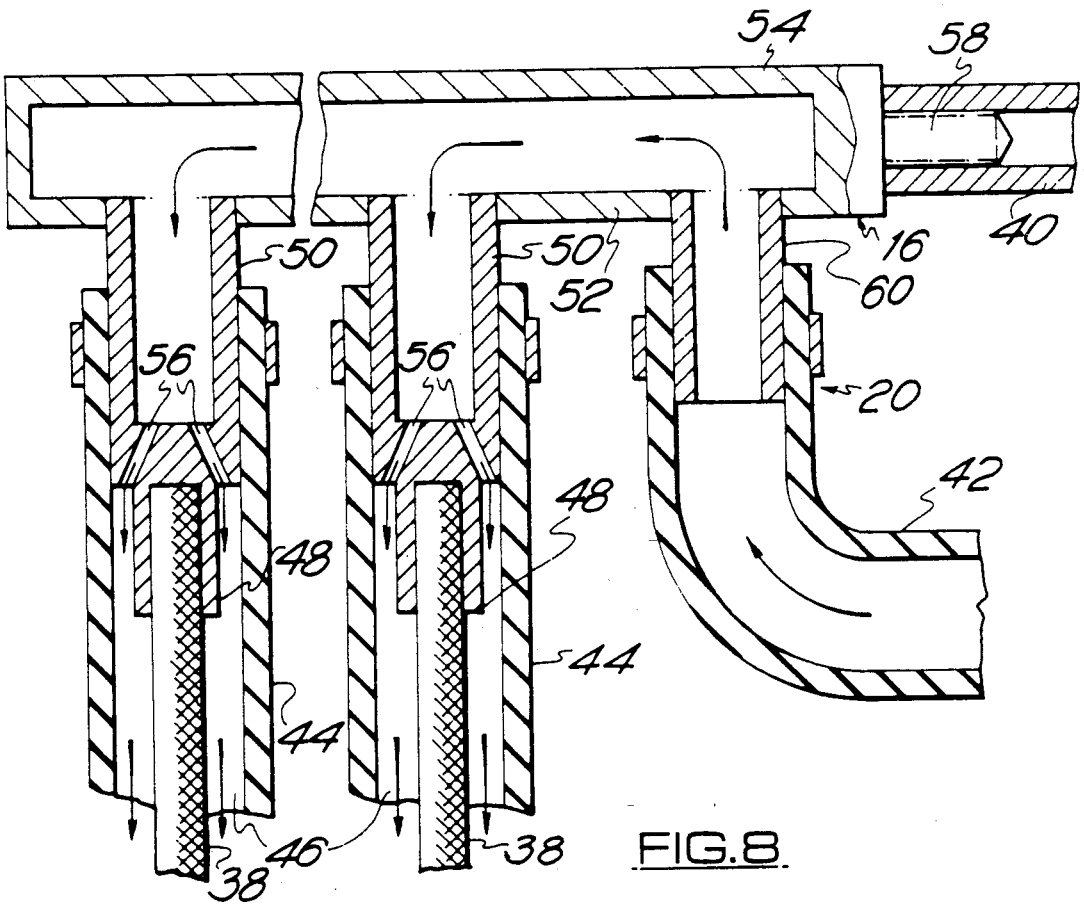
FIG. 8 is an axial cross section of a coil terminal as used in the induction heater of FIGS. 4–7.

As best seen in FIG. 8, each such conductor 38 comprises a flexible, multi-strand cable of round cross section, and is enclosed within a flexible pipe 44 of relatively large bore 46. The pipe is made of an electrically-insulating plastics material. At each of the terminals 16, the end of each conductor 38 is secured in a cable socket 48 which has its larger tubular end 50 secured in a water-tight manner in the wall 52 of a tube 54 (of square cross section) constituting the terminal 16. The end of the insulating pipe 44 which encloses the conductor 38 is secured in a water-tight manner around the outside of the tubular end 50 of the cable socket 48, and each cable socket 48 is provided with a plurality of oblique ducts 56 for enabling the passage of cooling water through the socket to or from the insulating pipe 44 surrounding the conductor 38.

The square terminal tube 54 carries at one closed end thereof a terminal stalk 58 on which is secured the electrical supply conductor 40, and adjacent that closed end a tubular coolant supply connector 60 to which is secured the water supply pipe 42.

Figure 4:
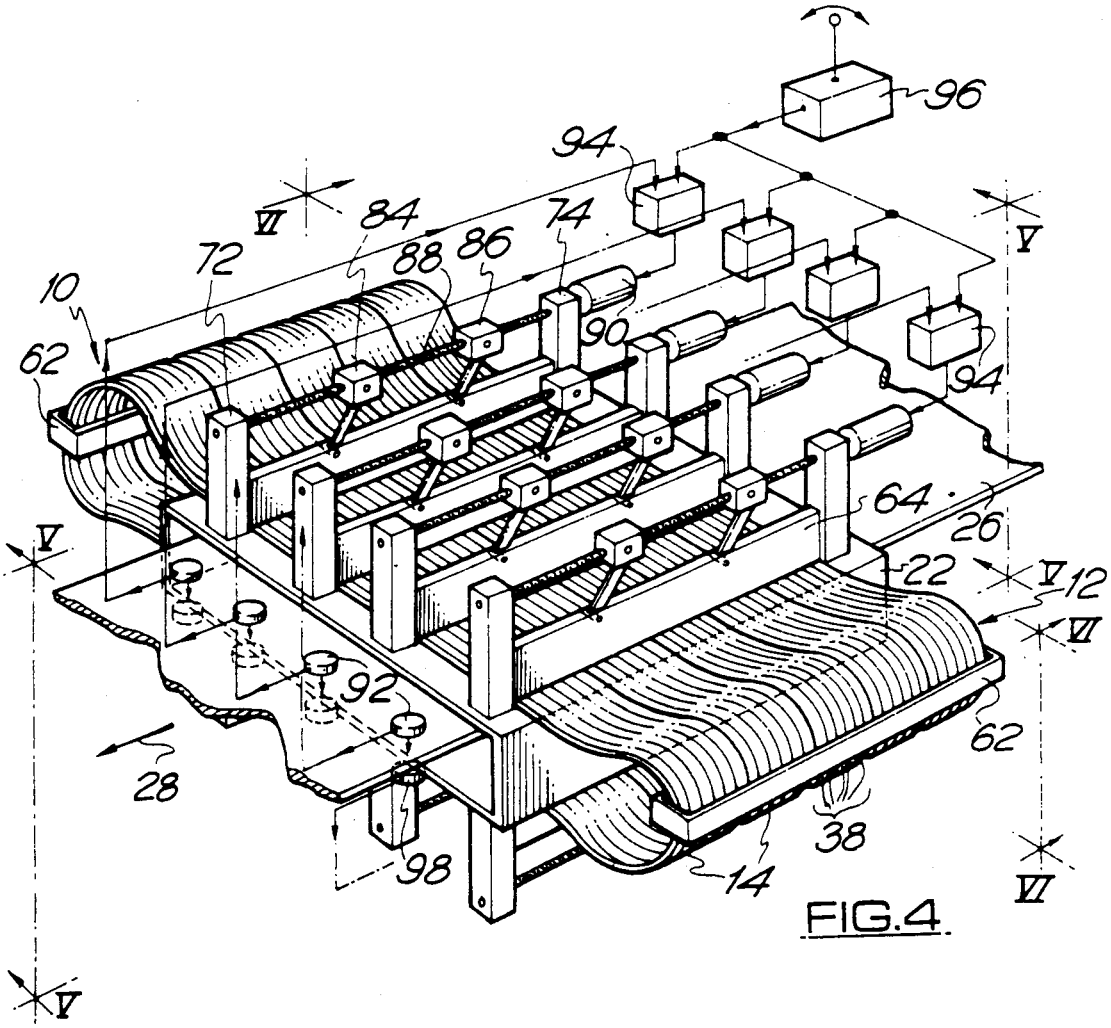
FIG. 4 is a perspective view of an induction heater according to the present invention as incorporated in said induction heating system.
Figure 5:
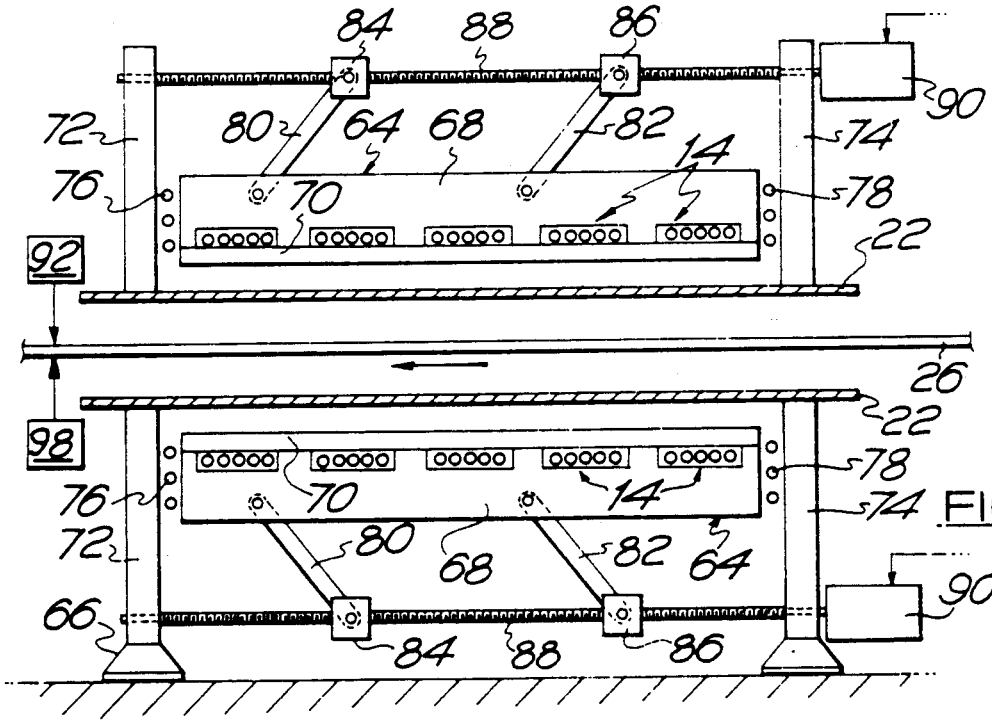
FIG. 5 is a longitudinal (axial) cross sectional view of the induction heater of FIG. 4, as seen at the section plane indicated at V—V, V—V in FIG. 4.
Figure 6:
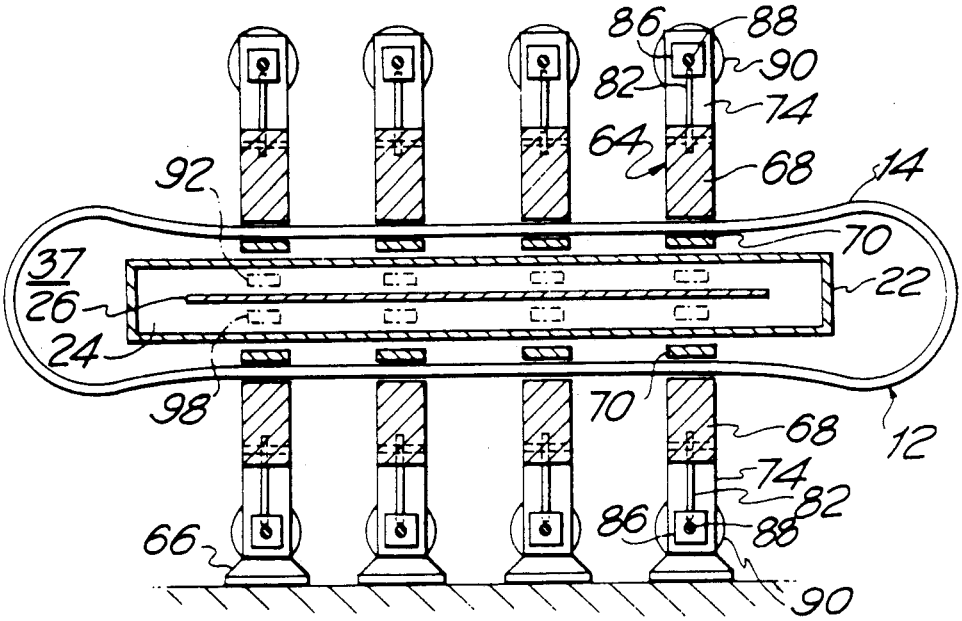
FIG. 6 is a transverse cross sectional view of the induction heater of FIG. 4, as seen at the section plane indicated at VI—VI, VI—VI in FIG. 4.
Figure 7:
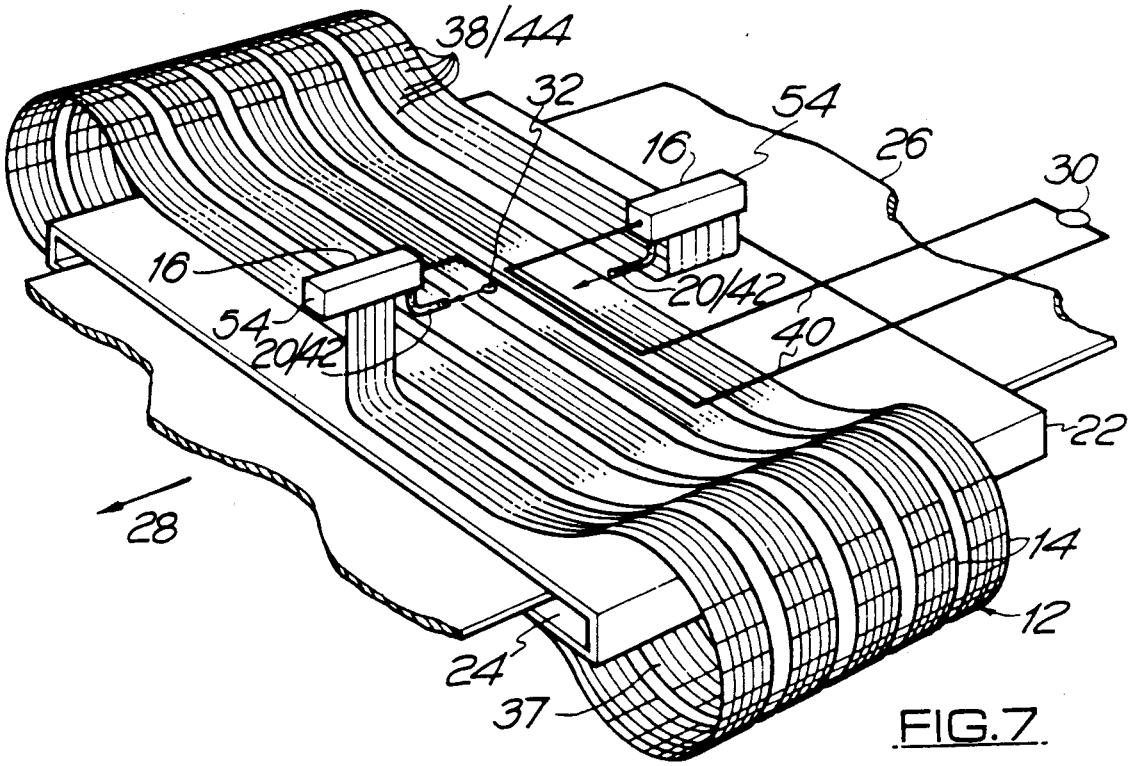
FIG. 7 is a perspective view of an induction heating coil incorporated in the induction heater of FIGS. 4–6.

As best shown in the FIGS. 4 and 5, the coil turns 14 are braced together and supported at a plurality of positions spaced around the coil 12 by respective longitudinal braces 62, 64 which are themselves carried on a supporting framework 66. For simplicity's sake, only relevant parts of that framework are shown in the drawings.

Whereas the braces 62 for supporting the sides of the coil turns 14 are fixed in position on the supporting framework 66, the braces 64 disposed above and below the tunnel tube 22 are adjustably mounted on that framework in a manner permitting movement of the braces towards and away from the metal strip 26 being heated, thereby to allow adjustment of the transverse shape of the coil throat 37, and hence of the distribution of magnetic flux in the metal strip.

Each adjustable brace 64 carries the respective multi-conductor coil turns 14 clamped between outer and inner brace members 68, 70, and is arranged for movement in a direction normal to the metal strip 26, (i.e. in a vertical direction as seen in the FIGS. 4 and 5) between vertical guide posts 72, 74 (forming part of the framework 66), being guided for movement therebetween by roller bearings 76, 78.

Each such brace 64 is pivotally carried at the respective inner ends of two parallel links 80, 82 whose outer ends are pivotally carried on respective screw-threaded blocks 84, 86. Those blocks are themselves engaged on a screw-threaded driving shaft 88 which is supported in bearings carried in the respective guide posts 72, 74, and is coupled to an electric driving motor 90 (preferably of the stepper kind).

The driving motor 90 and its associated driving shaft 88 constitute an actuator for adjusting the position of the brace 64 relative to the metal strip 26. Energisation of the driving motor is effective to move the two carrier blocks 84, 86 in concert along the driving shaft 88, and so rotate the parallel links 80, 82 about their pivotal connections on the brace 64. Since the brace is constrained against longitudinal movement by the vertical guide posts 72, 74, pivotal motion of the parallel links is effective to adjust the distance of the brace (and hence of the coil turns 14) from the metal strip 26, and hence the shape of the coil throat 37.

Temperature sensors 92 are disposed above the metal strip 26, on the downstream side of the tunnel tube 22 and in alignment with the respective braces 64, and provide output signals dependent on the surface temperatures of the adjacent upper surface of the metal strip 26.

Each driving motor 90 is energised by an associated closed loop control means 94 in accordance with the deviation of a temperature feedback signal provided by the associated temperature sensor 92 from a temperature reference level represented by a common reference signal provided by a manually adjustable temperature reference device 96.

The adjustable braces (64) below the tunnel tube 22 may be controlled by their respective closed loop control means 94 in dependence upon the output signals of the temperature sensors 92, or alternatively, in dependence upon output signals provided by their own individual temperature sensors 98 mounted beneath the metal strip in corresponding positions across the width of the strip.

Alternatively, the respective closed loop control means for driving the adjustable braces (64) carried below the tunnel tube may be dispensed with, and instead, the respective closed loop control means used for driving the respective braces above the tunnel tube may be used to drive in addition the corresponding adjustable braces carried below the tunnel tube.

In an alternative arrangement (not shown), five (instead of four) adjustable braces 64 are provided above the metal strip 26, and the reference signal for the closed loop control means 94 of the central brace is provided by a manually adjustable temperature reference device, whilst the temperature reference signals for the closed loop control means of the other braces on the same side of the tunnel tube are provided by the output (feedback) signal of the central temperature sensor. In that way, the surface temperature of the metal strip is maintained across the width of the strip in accordance with the temperature sensed at the centre of the strip width, whilst the latter sensed temperature is controlled by the setting of the reference device. A similar arrangement of adjustable braces may be provided on the underside of the tunnel tube, and may be controlled in the same way as the arrangement above the tunnel tube 22, so as to facilitate bonding of a film material to the underside of the metal strip 26, as well as to the upper side thereof.

The metallic parts of the framework 66, the braces 62, 64, and their adjustment means 80–88 are made of non-ferrous materials.

The temperature sensing devices 92, 98 may be of any convenient kind, for example, of the thermo-couple variety, or the infra-red pyrometer variety. Moreover, whilst specific temperature sensing devices are used to measure the surface tempertures at specific positions across the width of the metal strip, as an alternative, a single temperature sensing device may be continuously traversed to and fro across the width of the strip so as to provide an output signal which represents the temperature at the instantaneous position of the sensing device. In that case, the output of the sensing device is repetitively sampled so as to provide sensed temperature signals corresponding to specific positions across the width of the strip.

The terminal arrangement of FIG. 8 may be modified by combining the terminal stalk 58 and its associated supply cable 40 with the cooling water connector 60 and its associated water supply pipe 42. Such a modified arrangement may be otherwise generally similar to that shown in FIG. 8.

Figure 9:
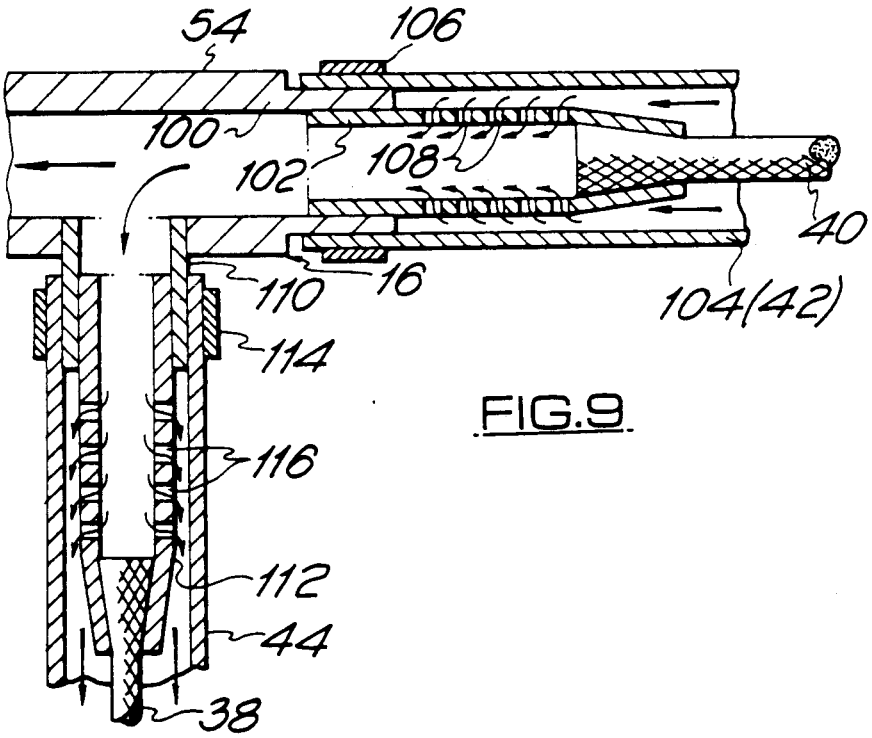
FIG. 9 shows a coil terminal construction which is an alternative to that shown in FIG. 8.

One terminal arrangement incorporating such a modification is shown in FIG. 9. There the terminal tube 54 is provided with an integral, tubular extension 100 (instead of the stalk 58), in which a tubular cable socket 102 is conductively secured, and around which a flexible, cooling water pipe 104 of an electrically insulating material is secured in a water-tight manner by a clip 106. A flexible, multi-strand electric supply cable 40 enclosed within the water pipe 104 is conductively secured in the convergent end part of the cable socket 102. Radial ports 108 formed in the cable socket 102 permit the passage of cooling water from the cooling water supply pipe 104 into the hollow terminal tube 54.

That tube carries in its lower wall other tubular, metal extensions 110 in which other tubular cable sockets 112 are conductively secured. The respective flexible, multi-strand conductors 38 are conductively secured in the lower convergent parts of the respective cable sockets 112, and their respective enclosing cooling water pipes 44 are secured in a water-tight manner around the respective tubular extensions 110 by clips 114. Radial ports 116 formed in the cable sockets 112 permit the flow of cooling water from the terminal tube 54 into the cooling water pipes 44 which enclose the multi-strand conductors 38.

Whereas each adjustable brace 64 is operated by two pivoted parallel links 80, 82, one of them could be omitted, and the other link connected to the brace at a more central position thereon. Moreover, any other convenient means for moving the braces 64 in a parallel manner towards and away from the strip 26 may be used instead, and any other convenient form of motive power (e.g. hydraulic or pneumatic motors) may be used for operating the respective brace adjustment means.

If desired, the driving motors 90 may be provided with alternative open-loop control means for enabling motorised adjustment of the respective braces as required, instead of continuous adjustment. Moreover, each brace may be provided with manual adjustment means (e.g. a winding handle or spanner) in addition to, or in substitution for, the driving motors and their respective control means, so as to provide an alternative manual mode, or a simple manual mode, of coil adjustment.

With the closed loop control means described above, it is considered possible to limit the sensed temperature variation across and along the strip to a very small amount (possibly of the order of +/−2° C.), on a strip having a width of 850 mm and an edge gauge reduction (feathering) of up to 8.5% of the central gauge.

Figure 10:
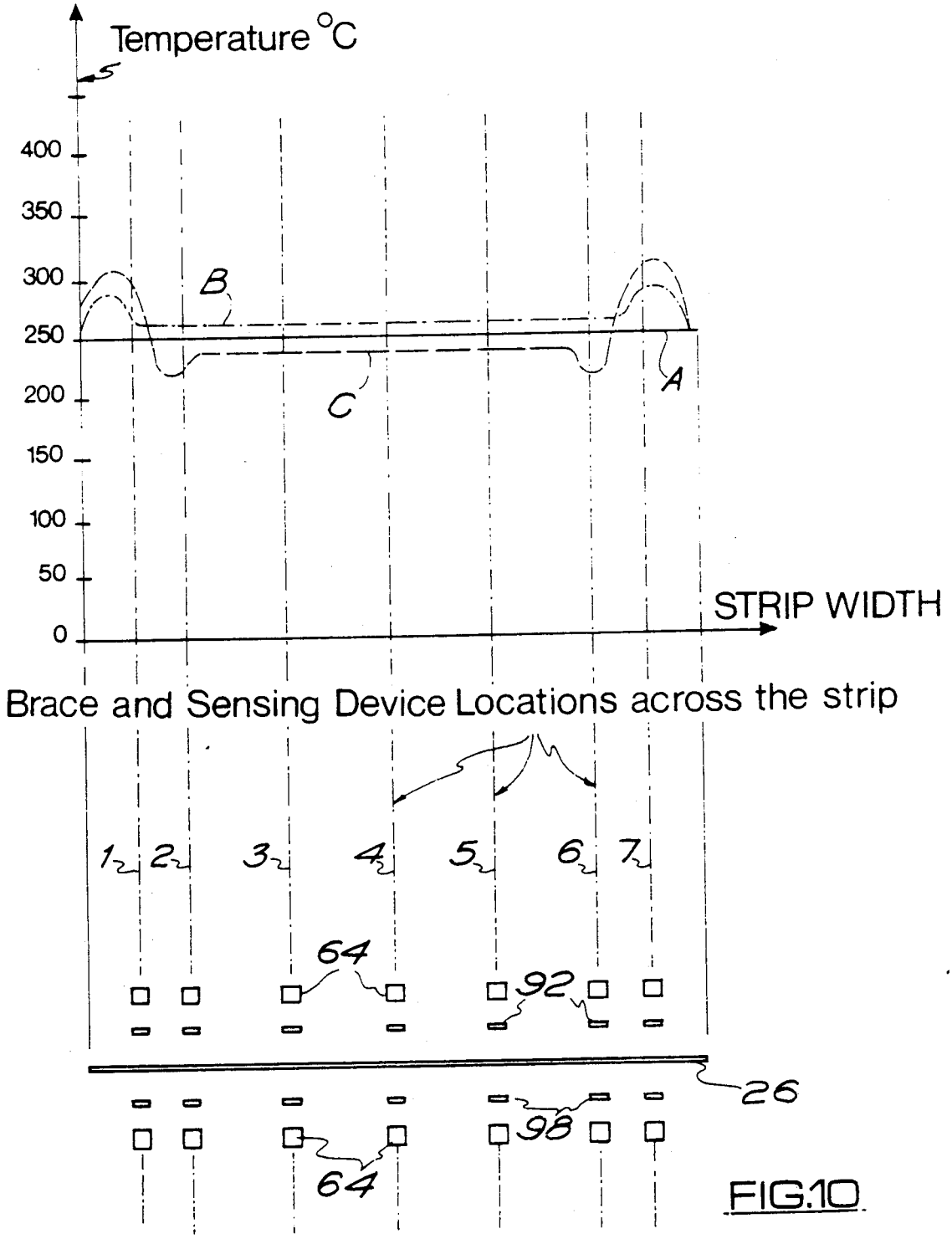
FIG. 10 shows various graphs depicting variations in strip temperature across the transverse width of the strip.

FIG. 10 shows for different positions across the transverse width of the metal strip 26 various temperature curves (profiles) indicating the manners in which strip temperature may vary across the strip width. Curve A shows a desired uniform temperature profile necessary for satisfactorily laminating the strip with polymer film. Curve B shows a typical non-uniform temperature profile which has been experienced with prior art arrangements, and which indicates the aforesaid rise in temperature at the edge portions of the strip. Curve C indicates a typical temperature profile which might otherwise be experienced in particular cases when the temperature-adjusted coil of the present invention is rendered inoperative.

The principles of the present invention may be applied to induction heating coils having any number of turns, even to single-turn coils, and to coils having any suitable number of adjustable braces for adjusting the coil throat characteristics.

Furthermore, in multi-turn coils, those principles may be applied to some only of the coil turns, which turns may, if desired, be braced together for simultaneous adjustment by respective adjustment means, the other coil turns being supported in a fixed configuration. In such a case, the fixed (non-adjustable) coil turns may be made in the conventional manner from solid, copper conductor material of thin rectangular transverse cross section, wound in the manner illustrated in the FIG. 1; whilst the adjustable coil turns are made of flexible, multi-strand cable of round transverse cross section in the manner of those shown in the FIGS. 4 to 9.

It will be appreciated from the aforegoing description that the present invention provides in an induction heating coil a readily available, in situ adjustability of the coil throat characteristics to suit the dimensions, the transverse shape, and the magnetic and other relevant physical characteristics of the workpiece that is to be heated.

Whereas the invention has been illustrated above with reference to one particular field of application, namely the heating of a thin, elongated metal strip material, the invention can be applied in other quite different fields of induction heating. For example, the invention can be applied in an analogous manner to the heating of strip and sheet metals of much greater thickness, and to the heating of strip and sheet materials having more complicated transverse cross sectional shapes, for example, rolled metal beams of 'I' section.

Whilst in the embodiment described above, the heating system has been arranged to maintain across the transverse width of the workpiece a uniform temperature profile, the system may be used in appropriate circumstances to maintain a desired non-uniform temperature profile across the workpiece width, by substituting for the single temperature reference device 96 a series of similar reference devices supplying to the respective control means 94 respective reference signals of different magnitudes.

It will be appreciated that the adjustability of the coil throat characteristics can be used in some cases solely to optimise and maintain a desired temperature profile for the workpiece to be heated, whilst in other cases, that adjustability may be used to provide the means for employing but one heating coil to heat various workpieces of widely differing characteristics, and also to provide for each such workpiece a suitable temperature profile.

Furthermore, the invention can be applied to any form of induction heating coil, regardless of its shape, size or configuration.

Whilst the concept of rendering the induction heating coil adjustable in-situ and as necessary, so as to vary its throat shape to suit any particular metal workpiece passing through the coil throat (i.e. along the magnetic axis of the coil), the same concept may be applied to induction heating coils which are intended to produce an oscillating or alternating magnetic flux directed transversely to a metal workpiece to be heated, that is, where the workpiece is arranged transversely to the magnetic axis of the coil.

Whilst in the FIG. 4 the coil braces 64 and their respective actuating mechanisms are shown uniformly spaced with respect to the width of the metal strip 26, they may be positioned in any other desired way to provide optimum results. For example, braces nearer the edge portions of the metal strip 26 may be closer together than braces adjacent the central portion of the strip 26. Moreover, the end braces 62 may be provided with actuating mechanisms similar to those of the braces 64, and be controlled in response to the output signals of temperature sensors 92, 98 appropriately positioned adjacent the edge portions of the metal strip.

We claim:

1. A method of induction heating an elongate metal strip, which method comprises the steps of:

(a) providing an induction heating coil comprising a plurality of flexible coil turns which together define a coil throat through which a magnetic axis of the coil extends, said coil turns being adjustable in shape in a plane transverse to said magnetic axis thereby to vary the shape of said coil throat;

(b) energising said coil with an electro-magnetic induction heating current thereby to produce a varying magnetic flux extending through said coil throat in the direction of said magnetic axis;

(c) moving said metal strip lengthwise progressively through said coil throat in said direction of said magnetic axis thereby to cause said magnetic flux to extend in said metal strip lengthwise in said direction of said magnetic axis and said metal strip to be heated by said varying magnetic flux;

(d) at each one of a plurality of temperature monitoring positions situated downstream of said coil throat and spaced apart across said metal strip in a direction transverse to that of said magnetic axis, monitoring the temperature of the heated metal strip as it emerges from said coil throat, thereby to produce respective control signals dependent respectively upon respective deviations of the respective monitored temperatures from respective reference values;

(e) continuously adjusting the positions of respective circumferentially-extending portions of said heating coil relative to said metal strip in accordance with the respective control signals and in directions to reduce said control signals, said circumferentially-extending portions of said coil being disposed in line in said direction of said magnetic axis with respective corresponding temperature monitoring positions, and said method being adapted to produce in said heated metal strip emerging from said coil throat a predetermined temperature profile across said metal strip in said transverse direction.

2. A method according to claim 1, wherein said respective reference values comprise a common reference value, thereby to provide a uniform temperature profile across said metal strip in said transverse direction.

3. A method according to claim 2, including at a central one of said monitoring positions, monitoring the temperature of the metal strip at that position thereby to produce a temperature signal dependent on the temperature at that position, and deriving from said temperature signal said reference values associated with other ones of said temperature monitoring positions.

4. A method according to claim 1, wherein said metal strip temperatures are monitored simultaneously at the respective temperature monitoring positions.

5. A method according to claim 1, wherein said metal strip temperatures are monitored sequentially at the respective temperature monitoring positions.

6. An electro-magnetic induction heating apparatus for induction heating an elongate metal strip, which apparatus comprises:

(a) an electro-magnetic induction heating coil comprising a plurality of flexible coil turns which together define a coil throat through which a magnetic axis of the coil extends, and through which said metal strip is progressively moved lengthwise in the direction of said magnetic axis thereby to be heated by said coil when electrically energised by an induction heating current, said coil turns being adjustable in shape in directions transverse to said magnetic axis thereby to vary the shape of said coil throat;

(b) a plurality of coil adjustment devices spaced circumferentially apart around said heating coil, each such adjustment device being (i) coupled to one of a plurality of circumferentially-extending portions of said heating coil and (ii) operable when activated to adjust the position of said one circumferentially-extending coil portion relative to said magnetic axis thereby to vary the shape of said coil throat;

(c) a plurality of temperature monitoring devices disposed downstream of said coil throat at respective monitoring positions spaced apart across said metal strip in a direction transverse to that of said magnetic axis, each said temperature monitoring device being adapted to provide a measurement of the temperature of said heated metal strip at the associated monitoring position as said metal strip emerges from said coil throat;

(d) a plurality of comparison devices, each said comparison device being (i) operatively associated with a respective one of said temperature monitoring devices, (ii) responsive to said temperature measurement of said one associated temperature monitoring device, and (iii) operative to determine from said temperature measurement the deviation thereof from a predetermined reference value; and (e) a plurality of activating devices, each said activating device being (i) operatively associated with a respective one of said comparison devices and with a respective coil adjustment device, (ii) responsive to said deviation determined by said associated comparison device, and (iii) operative in response to said deviation to cause said associated coil adjustment device to adjust said associated coil portion in a corrective sense thereby to vary said throat shape and so reduce said deviation.

7. Apparatus according to claim 6, wherein said induction heating coil includes a plurality of braces spaced circumferentially apart around said heating coil, each such brace securing said coil turns together for local adjustment together, and each such brace being coupled to an associated one of said adjustment devices for adjustment thereby.

8. Apparatus according to claim 7, wherein:

(a) each said brace comprises an axial member in which the respective coil turns are clamped;

(b) each said axial member is constrained by guide members for movement in a parallel manner in directions transverse to said magnetic axis;

(c) each said coil adjustment device includes a shaft disposed parallel with said magnetic axis, a carrier slidably mounted on said shaft and a link pivotally connecting said carrier with a said brace; and (d) each said activating device includes a driving means arranged for displacing said carrier along said shaft thereby to move the associated axial member in said corrective sense.

9. An induction heating coil according to claim 8, wherein each said coil adjustment device includes a second carrier which is likewise slidably mounted on said shaft for movement by said driving means in said axial direction, and a second link pivotally connecting said second carrier with said brace, said links being disposed in a parallel manner, and said carriers being spaced apart a predetermined distance so that the axial member moves in said parallel manner on synchronised movement of the two carriers by said driving means.

10. Apparatus according to claim 9, wherein said shaft and said carriers are screw-threaded in complementary manners, and said driving means is arranged to rotate said shaft thereby to displace the two carriers in said axial direction.

11. Apparatus according to claim 8, wherein each said activating means includes a temperature reference device for providing a temperature reference signal, and said activating means operates in response to deviation of said temperature measurement of the associated temperature monitoring device from said reference temperature signal thereby to activate said driving means and associated coil adjusting device in a sense to reduce said deviation.

12. Apparatus according to claim 11, wherein a temperature monitoring device for measuring the temperature at a central position on the heated metal strip emerging from the coil throat constitutes the respective temperature reference device of each of the respective activating means which effect adjustment of said braces at positions other than said central position.

13. Apparatus according to claim 12, wherein said coil turns are formed from a flexible multi-strand conductor.

14. Apparatus according to claim 13, wherein said coil turns comprise a plurality of multi-strand conductors arranged mechanically and electrically in parallel with one another.

15. Apparatus according to claim 14, wherein each said multi-strand conductor is drawn into a flexible pipe of a suitable electrically-insulting, plastics material and of a size such as to allow the flow of a cooling fluid through the pipe in direct contact with the multi-strand conductor thereby to cool that conductor when energised.

16. Apparatus according to claim 13, wherein said multi-strand conductor is disposed within a flexible pipe of a suitable electrically-insulating, plastics material and of a size such as to allow the flow of a cooling fluid through the pipe in direct contact with the multi-strand conductor thereby to cool that conductor when energised.

17. An electro-magnetic induction heating apparatus for induction heating an elongate metal strip, which apparatus comprises:

(a) an electro-magnetic induction heating coil comprising a plurality of flexible coil turns which together define a coil throat through which a magnetic axis of the coil extends, and through which said metal strip is progressively moved lengthwise in the direction of said magnetic axis thereby to be heated by said coil when electrically energised by an induction heating current, said coil turns being adjustable in shape in directions transverse to said magnetic axis thereby to vary the shape of said coil throat;

(b) a plurality of coil adjustment devices spaced circumferentially apart around said heating coil, each such adjustment device being (i) coupled to one of a plurality of circumferentially-extending portions of said heating coil and (ii) operable when activated to adjust the position of said one circumferentially-extending coil portion relative to said magnetic axis thereby to vary the shape of said coil throat;

(c) temperature monitoring means disposed downstream of said coil throat and adapted to provide respective measurements of the temperature of said heated metal strip at each of a plurality of temperature monitoring positions spaced apart across said metal strip in a direction transverse to that of said magnetic axis, (d) comparison means responsive to each said temperature measurement and adapted to provide respective control signals dependent on the deviations of respective temperature measurements from respective temperature reference values; and (e) a plurality of activating devices responsive respectively to said control signals and arranged to activate respective coil adjustment devices thereby to cause respective coil adjustment devices to adjust respective associated coil portions and thereby vary said throat shape in respective corrective senses and so reduce said control signals.

18. Apparatus according to claim 17, wherein said temperature monitoring means is arranged to provide said respective temperature measurements simultaneously.

19. Apparatus according to claim 17, wherein said temperature monitoring means is arranged to provide said respective temperature measurements sequentially.

* * * * *

UNITED STATES PATENT AND TRADEMARK OFFICE

CERTIFICATE OF CORRECTION

PATENT NO. : 5,055,647

DATED : October 8, 1991

INVENTOR(S) : Peter John Heyes et al.

It is certified that error appears in the above-identified patent and that said Letters Patent is hereby corrected as shown below:

On the title page, Item [73], Assignee please delete "CMB Packaging (UK) Limited" and insert --CMB Foodcan plc.--.

Signed and Sealed this

Thirtieth Day of March, 1993

*Attest:*

STEPHEN G. KUNIN

*Attesting Officer*

*Acting Commissioner of Patents and Trademarks*